US006601429B2

(12) United States Patent
Heitze

(10) Patent No.: US 6,601,429 B2
(45) Date of Patent: Aug. 5, 2003

(54) UPSETTING TOOL FOR FORMING CONTINUOUS CAST SLAB IN SLAB UPSETTING PRESSES

(75) Inventor: Gerhard Heitze, Netphen (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/821,824

(22) Filed: Mar. 29, 2001

(65) Prior Publication Data

US 2001/0045117 A1 Nov. 29, 2001

(30) Foreign Application Priority Data

Apr. 12, 2000 (DE) ..... 100 17 965
Oct. 9, 2000 (DE) ..... 100 49 782

(51) Int. Cl.[7] ..... B21J 13/02; B21B 15/00

(52) U.S. Cl. ..... 72/407; 72/416; 72/447; 72/206

(58) Field of Search ..... 72/206, 407, 416, 72/377, 447

(56) References Cited

U.S. PATENT DOCUMENTS 3,916,668 A * 11/1975 Schmoll et al. ..... 72/407
3,992,917 A * 11/1976 Kralowetz ..... 72/407
4,502,311 A * 3/1985 Eibe ..... 72/206

FOREIGN PATENT DOCUMENTS

| | | | | |
|---|---|---|---|---|
| DE | 3040947 | | 1/1990 | |
| DE | 196 00 477 A1 | | 7/1997 | |
| EP | 0112516 | | 5/1988 | |
| EP | 0400385 | | 7/1994 | |
| JP | 61-202705 | * | 9/1986 | ..... 72/206 |
| JP | 1-241301 | * | 9/1989 | |

OTHER PUBLICATIONS

Patent Abstracts of Japan, vol. 013, No. 577 (M–910), Dec. 20, 1989 & JP 01 241301 A (Ishikawajima Harima Heavy Ind Co Lyd), Sep. 26, 1989.

* cited by examiner

*Primary Examiner*—Daniel C. Crane
(74) *Attorney, Agent, or Firm*—Friedrich Kueffner

(57) ABSTRACT

An upsetting tool for forming continuous cast slab in upsetting presses has one or more first plane upsetting surfaces extending at a slant to a transport direction of the slab being transported through the upsetting press. A second plane upsetting surface extends parallel to the transport direction of the slab and parallel to longitudinal sides of the slab. The first and second upsetting surfaces adjoin one another at a first slant angle. Calibrating upsetting surfaces are provided, and the calibrating upsetting surfaces and the plane upsetting surfaces are positioned above one another.

3 Claims, 1 Drawing Sheet

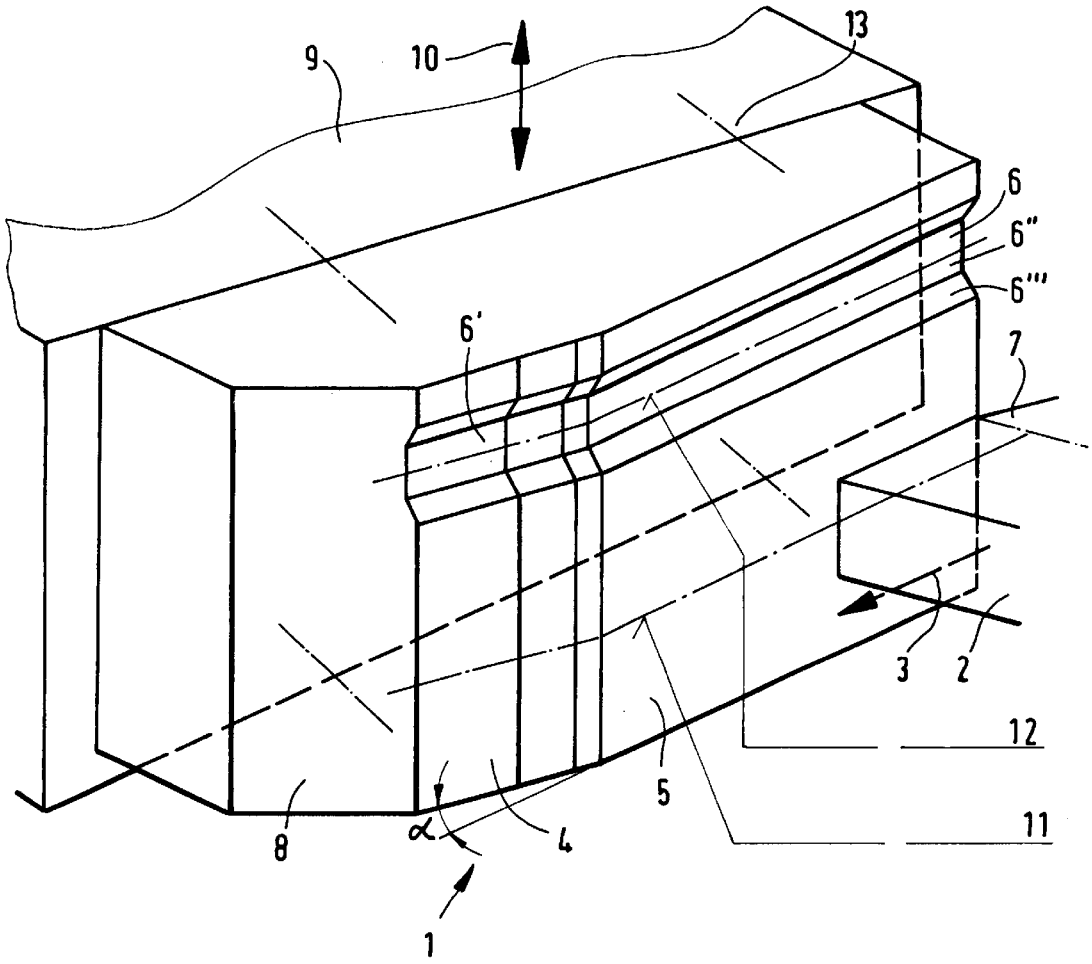
9
10
13
6
6"
6'''
6'
7
3
2
12
5
11
8
α
4
1

UPSETTING TOOL FOR FORMING CONTINUOUS CAST SLAB IN SLAB UPSETTING PRESSES

BACKGROUND OF THE INVENTION

1. Field of the Invention

The invention relates to an upsetting tool for forming continuous cast slab in upsetting presses with at least one upsetting surface positioned at a slant to the transport direction of the slab and an upsetting surface positioned parallel to the transport direction of the slab and to its longitudinal side surfaces, wherein the upsetting surfaces adjoin one another at a slant angle $\alpha$, respectively.

2. Description of the Related Art

Upsetting presses serve for reducing the width of rolled goods, in particular, the slab width in hot-rolled wide strip blooming trains. The upsetting presses have for this purpose on both sides of the slab edges pressing tools that are facing one another.

An upsetting press of the aforementioned configuration is known, for example, from European patent application 0 112 516 and comprises a pair of pressing tools which are arranged on both wide sides of a slab blooming train such that their pressing surfaces provided for pressing the slab face one another. One of these pressing surfaces is substantially parallel to the slab advancing direction, the other pressing surface has a surface that is slanted relative to the slab advancing direction.

A vibration unit causes the pressing tool and its parallel and slanted surfaces to vibrate. This known upsetting press comprises moreover a width control unit for controlling the position of the pressing tool in the slab width direction and a control which detects whether the front end of the slab is arranged between the parallel surfaces of the pressing tool and which then actuates the width control device as well as the vibration unit after a certain pressing action has been performed.

From European patent 0 400 385 a flying upsetting press for reduction of the width of slab in hot-rolled wide strip blooming trains is known. The pressing tools required for width reduction of the slab are secured on a tool holder. A crank gear is provided to realize the reduction drive of the pressing tool. The crank gear acts on a guide rod system which is movable in the direction of reduction. The crank gear is arranged in a crank housing which is adjustably arranged in a horizontal press stand. An advancing drive engages the tool holder and acts essentially in the direction of slab advancement. When the advancing drive is not actuated, this known upsetting press can be operated by stop and go operation. The construction of this upsetting press has been proven successful in practice.

From German patent document 196 00 477 A1 an upsetting tool for forming continuous cast slab in slab upsetting presses is known. The upsetting forming surface of this upsetting tool is comprised of several forming surfaces which extended a slant relative to the transport direction of the slab and a further upsetting forming surface which extends parallel to the longitudinal sides of the slab. In the feeding direction of the slab into the upsetting press the slant angle $\alpha$ of the upsetting forming surface is approximately 19 to 20 degrees. The successively arranged three transitional upsetting forming surfaces have a slant angle of approximately 0.9 to 10 degrees and the exit surface of the upsetting tool has a slant angle $\beta$ of 12 degrees. With such upsetting tools it is achieved that the slab material during upsetting flows better toward the center of the slab and that, despite a width upsetting of approximately 300 mm, a cross-section of the upset slab is produced which can be called approximately rectangular.

From German patent document 30 40 947 C2 an upsetting press is known whose tools are designed such that the slab when subjected to a lateral upsetting action can neither bend upwardly nor downwardly. For this purpose securing plates are arranged above and below the slab. The upsetting tools for laterally upsetting the slab have U-shaped cutouts and surround the edge areas of the slab to a significant amount in order to prevent, together with the holding plates of the device, the bending of the slab during the upsetting process.

SUMMARY OF THE INVENTION

It is an object of the present invention to improve the upsetting tool of a slab upsetting press and to design it to be more universal with respect to applications in order to be able to upset the slab areally as well as in a width-calibrating fashion.

In accordance with the present invention, this is achieved in that the upsetting tool has plane upsetting surfaces as well as calibrating upsetting surfaces which are arranged above one another on the upsetting tool.

With this measure, a combination upsetting tool is provided which has two pressing positions on one and the same tool so that even during passage of a slab through the upsetting press it is possible to switch from a calibrating upsetting to an areal (surface) upsetting or vice versa. Depending on material and temperature of the slab, this has advantages with respect to the flow behavior of the material toward the slab center so that the so-called dog bone cross-sections can be substantially prevented and a substantially rectangular cross-sectional shape will be formed. Also, the formation of a tongue and fishtail on the respective end of the slab can be substantially prevented with the upsetting tool according to the present invention.

In an advantageous embodiment of the upsetting tool it is proposed that the slant angle $\alpha$ of the plane upsetting surfaces and of the calibrating surfaces correspond to one another. Since the slant angle on the upsetting tool inter alia determines the force requirement for lateral upsetting of the slab, it is advantageous to provide identical slant angles for the two pressing positions of the pressing tool.

In a further development of the inventive concept, it is proposed that the calibrating upsetting surfaces of the upsetting tool, viewed in cross-section, have substantially a U-shape that opens toward a longitudinal side of the slab. In this connection it is expedient that the U-shaped calibrating upsetting surface is comprised of a plane base surface and two leg surfaces that are positioned at a slant thereto and open outwardly. By means of these pressing surfaces, the dog bone formation on the longitudinal sides of the slab is avoided especially effectively.

In a preferred further development of the invention, it is proposed that the upsetting tool is connected with a tool holder of the upsetting press and can be moved vertically up and down in a direction parallel to the longitudinal side surface of the slab into an alternative pressing position relative to the slab in such a way that the slab can be reduced with regard to its width either with the plane upsetting surface or with the calibrating upsetting surface. By means of this measure, the combination upsetting tool with its two pressing positions is usable especially quickly and universally. Moreover, it is possible to optimally reduce the slab width during one pass through the upsetting press by means of two different pressing surfaces.

BRIEF DESCRIPTION OF THE DRAWING

In the drawing the only FIGURE shows a perspective view of an upsetting tool according to the invention.

DESCRIPTION OF THE PREFERRED EMBODIMENTS

The perspectively illustrated upsetting tool 1 for the lateral deformation of continuous cast slab 2 is a combination upsetting tool with two pressing positions 11 and 12 provided on the tool. The upsetting tool 1 is provided with a plane upsetting surface 5 positioned at a slant relative to the transport direction 3 of the slab 2 and with a further upsetting surface 4 extending parallel to the transport direction 3 of the slab 2 and to its longitudinal side surfaces 7. The two upsetting surfaces 4 and 5 adjoin one another at a slant angle $\alpha$. Above the plane upsetting surfaces 4, 5, calibrating upsetting surfaces 6, 6' are arranged. The exit area of the upsetting tool shows a slanted and plane surface 8 at its end which is correlated with the two upsetting surfaces extending parallel to the transport direction 3 of the slab 2, i.e., with the calibrating upsetting surface 6' and the plane upsetting surface 4. The upsetting tool 1 is fixedly but exchangeably connected by means of self-locking connections with a tool holder 9 on at least four connecting points 13. The tool holder 9 is, for example, moved by a crank gear perpendicularly to the transport direction 3 toward and away from the slab so that the lateral upsetting of the slab is effected. In the inlet area of the upsetting tool 1, the leading end of the slab 2, which has already been partially upset, can be seen which will now pass through the upsetting press in the transport direction 3.

The slant angle $\alpha$ of the plane upsetting surface 4 and the slant angle $\alpha$ of the calibrating upsetting surface 6' match one another. In cross-section, the calibrating upsetting surface 6, 6' is substantially U-shaped and open toward the longitudinal side 7 of the slab. The U-shape of the calibrating upsetting surface 6, 6' is comprised of a plane base surface 6" and two slantedly arranged leg surfaces 6'" opening outwardly. It is proposed that the opening width of the calibrating upsetting surface 6 is smaller or greater than the width of the slab.

As described above, the upsetting tool is connected with detachable locking devices 13 to the tool holder 9. The tool holder 9 is moved vertically up and down by means of a lifting device, not illustrated, in the direction of arrow 10 and parallel to the longitudinal side surface 7 of the slab 2 into an alternative pressing position relative to the slab such that the slab 2 is width-reduced either by the plane upsetting surface 4, 5 (pressing position 11) or by the calibrating upsetting surfaces 6, 6' (pressing position 12).

The illustrated combination upsetting tool makes possible—during a pass of the slab 2 through the upsetting press—the lateral upsetting of the slab with two different forming surfaces so that an optimal, substantially rectangular cross-sectional shape of the slab results and the dog bone shape, typical in the prior art, is at least significantly reduced.

While specific embodiments of the invention have been shown and described in detail to illustrate the inventive principles, it will be understood that the invention may be embodied otherwise without departing from such principles.

What is claimed is:

1. An upsetting tool for forming continuous cast slab in upsetting presses, the upsetting tool comprising:

one or more first plane upsetting surfaces and first calibrating upsetting surfaces, wherein the first plane upsetting surfaces and the first calibrating upsetting surfaces extend at a same slant to a transport direction of the slab being transported through the upsetting press and are positioned above one another;

a second plane upsetting surface and second calibrating upsetting surfaces, wherein the second plane upsetting surfaces and the second calibrating upsetting surfaces are positioned above one another and extend parallel to the transport direction of the slab and parallel to longitudinal sides of the slab;

wherein the first and second upsetting surfaces adjoin one another at a first slant angle and the first and second calibrating upsetting surfaces adjoin one another at a second slant angle, wherein the first and second slant angles are identical;

a slanted, plane end surface adjoining the second plane upsetting surface and the second calibrating surfaces.

2. The upsetting tool according to claim 1, wherein the first and second calibrating upsetting surfaces are arranged above the first and second plane upsetting surfaces relative to the longitudinal sides of the slab.

3. The upsetting tool according to claim 1, configured to be connected to a tool holder of the upsetting press and configured to be moved up and down vertically and parallel to the longitudinal sides of the slab into a first pressing position and into a second pressing position relative to the slab, wherein in the first pressing position the first and second plane upsetting surfaces act on the slab to reduce a width of the slab and in the second pressing position the first and second calibrating surfaces act on the slab to reduce a width of the slab.

* * * * *